US012710238B2

(12) United States Patent
Zhang et al.

(10) Patent No.: US 12,710,238 B2
(45) Date of Patent: Aug. 18, 2026

(54) PLATE HEAT EXCHANGER WITH IMPROVED CONNECTION STRENGTH

(71) Applicant: Hangzhou Sanhua Research Institute Co., LTD., Hangzhou City (CN)

(72) Inventors: Xiaobin Zhang, Hangzhou City (CN); Ting Zhang, Hangzhou City (CN); Lingjie Zhang, Hangzhou City (CN); Gaofei Zhou, Hangzhou City (CN); Jiankang Zhang, Hangzhou City (CN)

(73) Assignee: HANGZHOU SANHUA RESEARCH INSTITUTE CO., LTD., Hangzhou City (CN)

( * ) Notice: Subject to any disclaimer, the term of this patent is extended or adjusted under 35 U.S.C. 154(b) by 327 days.

(21) Appl. No.: 18/489,840

(22) Filed: Oct. 18, 2023

(65) Prior Publication Data

US 2024/0133640 A1 Apr. 25, 2024
US 2024/0230246 A9 Jul. 11, 2024

(30) Foreign Application Priority Data

Oct. 19, 2022 (CN) ..... 202211277267.6

(51) Int. Cl.
*F28F 3/00* (2006.01)
*F28D 9/00* (2006.01)
(Continued)

(52) U.S. Cl.
CPC ..... *F28F 3/086* (2013.01); *F28D 9/005* (2013.01); *F28D 9/0025* (2013.01);
(Continued)

(58) Field of Classification Search
CPC ..... F28F 3/086; F28F 3/08; F28F 3/04; F28F 2225/08; F28D 9/005; F28D 9/0025; F28D 9/0037
(Continued)

(56) References Cited

U.S. PATENT DOCUMENTS 4,911,235 A * 3/1990 Andersson ..... F28F 3/083 165/166
9,874,409 B2 * 1/2018 Ito ..... F28F 9/026
(Continued)

FOREIGN PATENT DOCUMENTS

CN 202869325 U 4/2013
CN 102809311 B 5/2015
(Continued)

*Primary Examiner* — Joel M Attey
(74) *Attorney, Agent, or Firm* — Cheng-Ju Chiang

(57) ABSTRACT

A plate heat exchanger includes a number of first heat exchange plates and a number of second heat exchange plates. The plate heat exchanger has a first inter-plate channel and a second inter-plate channel. The first inter-plate channel is located between a front surface of the second heat exchange plate and an adjacent first heat exchange plate. The second inter-plate channel is located between a back surface of the second heat exchange plate and another adjacent first heat exchange plate. The first heat exchange plate has a first flat joint portion and a second flat joint portion. The front surface of the second flat joint portion is spaced apart from an adjacent first flat joint portion. The plate heat exchanger includes at least one connection portion connecting the front surface of the second flat joint portion and the adjacent first flat joint portion.

17 Claims, 15 Drawing Sheets

(51) Int. Cl.
*F28F 3/08* (2006.01)
*F28F 3/04* (2006.01)

(52) U.S. Cl.
CPC ..... *F28D 9/0037* (2013.01); *F28F 3/04* (2013.01); *F28F 3/08* (2013.01); *F28F 2225/08* (2013.01)

(58) Field of Classification Search
USPC ..... 165/167
See application file for complete search history.

(56) References Cited

U.S. PATENT DOCUMENTS

| | | | | |
|---|---|---|---|---|
| 2012/0012291 | A1* | 1/2012 | Ito | F28F 9/026 165/166 |
| 2015/0292803 | A1* | 10/2015 | Nyander | B23P 15/26 29/890.03 |
| 2019/0310033 | A1 | 10/2019 | Li et al. | |
| 2022/0120519 | A1* | 4/2022 | Sawada | F28F 9/0221 |
| 2023/0349645 | A1* | 11/2023 | Zhang | F28F 3/025 |

FOREIGN PATENT DOCUMENTS

| | | | |
|---|---|---|---|
| CN | 112444149 | A | 3/2021 |
| CN | 218723391 | U | 3/2023 |
| CN | 116817644 | A | 9/2023 |
| JP | 2015-102279 | A | 6/2015 |
| JP | 2019-219091 | A | 12/2019 |
| KR | 10-2020-0025848 | A | 3/2020 |

* cited by examiner

PLATE HEAT EXCHANGER WITH IMPROVED CONNECTION STRENGTH

CROSS-REFERENCE TO RELATED APPLICATION

The present disclosure claims priority of a Chinese Patent Application No. 202211277267.6, filed on Oct. 19, 2022 and titled "PLATE HEAT EXCHANGER", the entire content of which is incorporated herein by reference.

TECHNICAL FIELD

The present disclosure belongs to the field of heat exchangers, and in particular, relates to a plate heat exchanger.

BACKGROUND

Plate heat exchangers are widely used in refrigeration and heating systems as evaporators, condensers and economizer, etc., due to their compact structure, high heat transfer coefficient, strong reliability, and small refrigerant charge.

Corner holes of plate heat exchangers usually need to withstand higher pressures, so it is necessary to increase the strength at the inlet.

SUMMARY

An object of the present disclosure is to provide a plate heat exchanger with improved connection strength.

In order to achieve the above object, the present disclosure adopts the following technical solution: a plate heat exchanger, including: a plurality of plates stacked along a thickness direction of the plate heat exchanger; the plurality of plates including a plurality of first heat exchange plates and a plurality of second heat exchange plates; the first heat exchange plate and the second heat exchange plate being disposed alternately along the thickness direction of the plate heat exchanger; wherein the plate heat exchanger has a first inter-plate channel and a second inter-plate channel; the first inter-plate channel is located between a front surface of a corresponding second heat exchange plate and a corresponding first heat exchange plate disposed adjacent to the corresponding second heat exchange plate along the thickness direction of the plate heat exchanger; the second inter-plate channel is located between a back surface of the corresponding second heat exchange plate and another corresponding first heat exchange plate disposed adjacent to the corresponding second heat exchange plate along the thickness direction of the plate heat exchanger; each first heat exchange plate and each second heat exchange plate have first corner holes corresponding with each other and communicating with the first inter-plate channel; the first heat exchange plate has a first flat joint portion in which the first corner hole of the first heat exchange plate is located; the second heat exchange plate has a second flat joint portion in which the first corner hole of the second heat exchange plate is located; a front surface of the second flat joint portion is at least partially spaced from an adjacent first flat joint portion; a back surface of the second flat joint portion is at least partially connected to another adjacent first flat joint portion; each first heat exchange plate and each second heat exchange plate have second corner holes corresponding with each other and communicating with the first inter-plate channel; on a plane perpendicular to the thickness direction of the plate heat exchanger, a projected area of at least one of the first flat joint portion and the second flat joint portion is larger than a projected area of a flat joint portion of the first heat exchange plate on a peripheral side of the second corner hole; the projected area of at least one of the first flat joint portion and the second flat joint portion is larger than a projected area of a flat joint portion of the second heat exchange plate on a peripheral side of the second corner hole; the plate heat exchanger includes at least one connection portion which connects the front surface of the second flat joint portion and the adjacent first flat joint portion.

In order to achieve the above object, the present disclosure adopts the following technical solution: a plate heat exchanger, including: a plurality of plates stacked along a thickness direction of the plate heat exchanger; the plurality of plates including a plurality of first heat exchange plates and a plurality of second heat exchange plates; the first heat exchange plate and the second heat exchange plate being disposed alternately along the thickness direction of the plate heat exchanger; wherein the plate heat exchanger has a first inter-plate channel configured to circulate a refrigerant and a second inter-plate channel configured to circulate a heat exchange medium; the first inter-plate channel is not in fluid communication with the second inter-plate channel; the first inter-plate channel is located between a front surface of a corresponding second heat exchange plate and a corresponding first heat exchange plate disposed adjacent to the corresponding second heat exchange plate along the thickness direction of the plate heat exchanger; the second inter-plate channel is located between a back surface of the corresponding second heat exchange plate and another corresponding first heat exchange plate disposed adjacent to the corresponding second heat exchange plate along the thickness direction of the plate heat exchanger; each first heat exchange plate and each second heat exchange plate have first corner holes corresponding with each other and communicating with the first inter-plate channel; the first heat exchange plate has a first flat joint portion in which the first corner hole of the first heat exchange plate is located; the second heat exchange plate has a second flat joint portion in which the first corner hole of the second heat exchange plate is located; a front surface of the second flat joint portion is at least partially spaced from an adjacent first flat joint portion; a back surface of the second flat joint portion is at least partially connected to another adjacent first flat joint portion; each first heat exchange plate and each second heat exchange plate have second corner holes corresponding with each other and communicating with the first inter-plate channel; the plate heat exchanger includes a plurality of connection blocks which are independent components before being assembled and connected to the plurality of first heat exchange plates and the plurality of second heat exchange plates; each connection block connects the front surface of the second flat joint portion and the adjacent first flat joint portion.

By providing the connection portion or the connection block, the plate heat exchanger of the present disclosure improves the connection strength between the front surface of the second flat joint portion and the adjacent first flat joint portion which are disposed at intervals.

DETAILED DESCRIPTION

Figure 1:
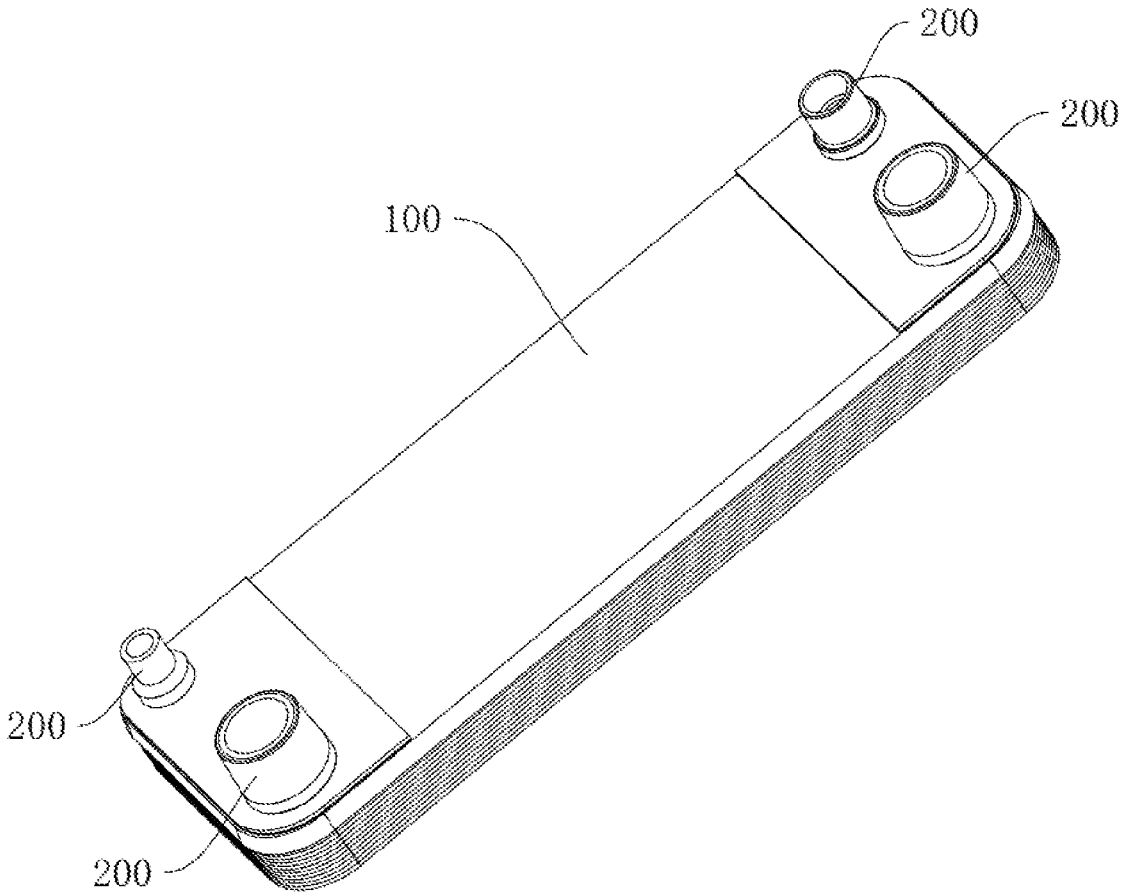
FIG. 1 is a perspective view of a plate heat exchanger in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

As shown in FIGS. 1 to 15, the present embodiment provides a plate heat exchanger, which includes a plurality of plates stacked along a thickness direction of the plate heat exchanger. The plurality of plates include a plurality first heat exchange plates and a plurality of second heat exchange plates. The first heat exchange plate and the second heat exchange plate are stacked alternately along the thickness direction of the plate heat exchanger. The first heat exchange plate and the second heat exchange plate are located adjacent to each other along the thickness direction of the plate heat exchanger. The plate heat exchanger has a first inter-plate channel 3 and a second inter-plate channel 4. The first inter-plate channel 3 is located between a front surface of one second heat exchange plate 2 and one first heat exchange plate 1 located adjacent to the second heat exchange plate 2 along one side. The second inter-plate channel 4 is located between a back surface of the second heat exchange plate 2 and another first heat exchange plate 1 located adjacent to the second heat exchange plate 2 along another side. In the illustrated embodiment of the present disclosure, a plurality of first inter-plate channels 3 and a plurality of second inter-plate channels 4 are provided and are alternately distributed along the thickness direction of the plate heat exchanger (for example, a X direction shown in FIG. 2). The first heat exchange plate 1 and the second heat exchange plate 2 have first corner holes F1 corresponding to each other. The first corner holes F1 communicate with the first inter-plate channel 3. The first heat exchange plate 1 has a first flat joint portion 1*a* in which the first corner hole F1 of the first heat exchange plate 1 is located. The second heat exchange plate 2 has a second flat joint portion 2*a* in which the first corner hole F1 of the second heat exchange plate 2 is located. The front surface of the second flat joint portion 2*a* is at least partially spaced from an adjacent first flat joint portion 1*a*. The back surface of the second flat joint portion 2*a* is at least partially connected to the adjacent first flat joint portion 1*a*. In this embodiment, the first inter-plate channels 3 are configured to circulate a refrigerant. The first corner holes F1 are configured to allow the refrigerant to flow into the first inter-plate channels 3. The second inter-plate channels 4 are configured to circulate a heat exchange medium (such as water) that exchanges heat with the refrigerant in the first inter-plate channels 3. The second inter-plate channels 4 are not in fluid communication with the first inter-plate channels 3. The first heat exchange plate 1 and the second heat exchange plate 2 have second corner holes F2 corresponding with each other. The second corner holes F2 communicate with the first inter-plate channels 3. The second corner hole F2 is configured to allow the refrigerant to flow out of a corresponding first inter-plate channel 3. On a plane perpendicular to the thickness direction of the plate heat exchanger, a projected area of at least one of the first flat joint portion 1*a* and the second flat joint portion 2*a* in the plane is larger than a projected area of a flat joint portion of the first heat exchange plate 1 on a peripheral side of the second corner hole F2 in the plane. The projected area of at least one of the first flat joint portion 1*a* and the second flat joint portion 2*a* in the plane is larger than a projected area of a flat joint portion of the second heat exchange plate 2 on the peripheral side of the second corner hole F2 in the plane. In this embodiment, the first corner hole F1 and the second corner hole F2 are in fluid communication with the first inter-plate channel 3. The first corner hole F1 is located at a connection portion of the first flat joint portion 1*a* and the second flat joint portion 2*a*. Furthermore, an area of the flat joint portion on a peripheral side of the first corner hole F1 is larger than an area of the flat joint portion on the peripheral side of the second corner hole F2.

Figure 14:
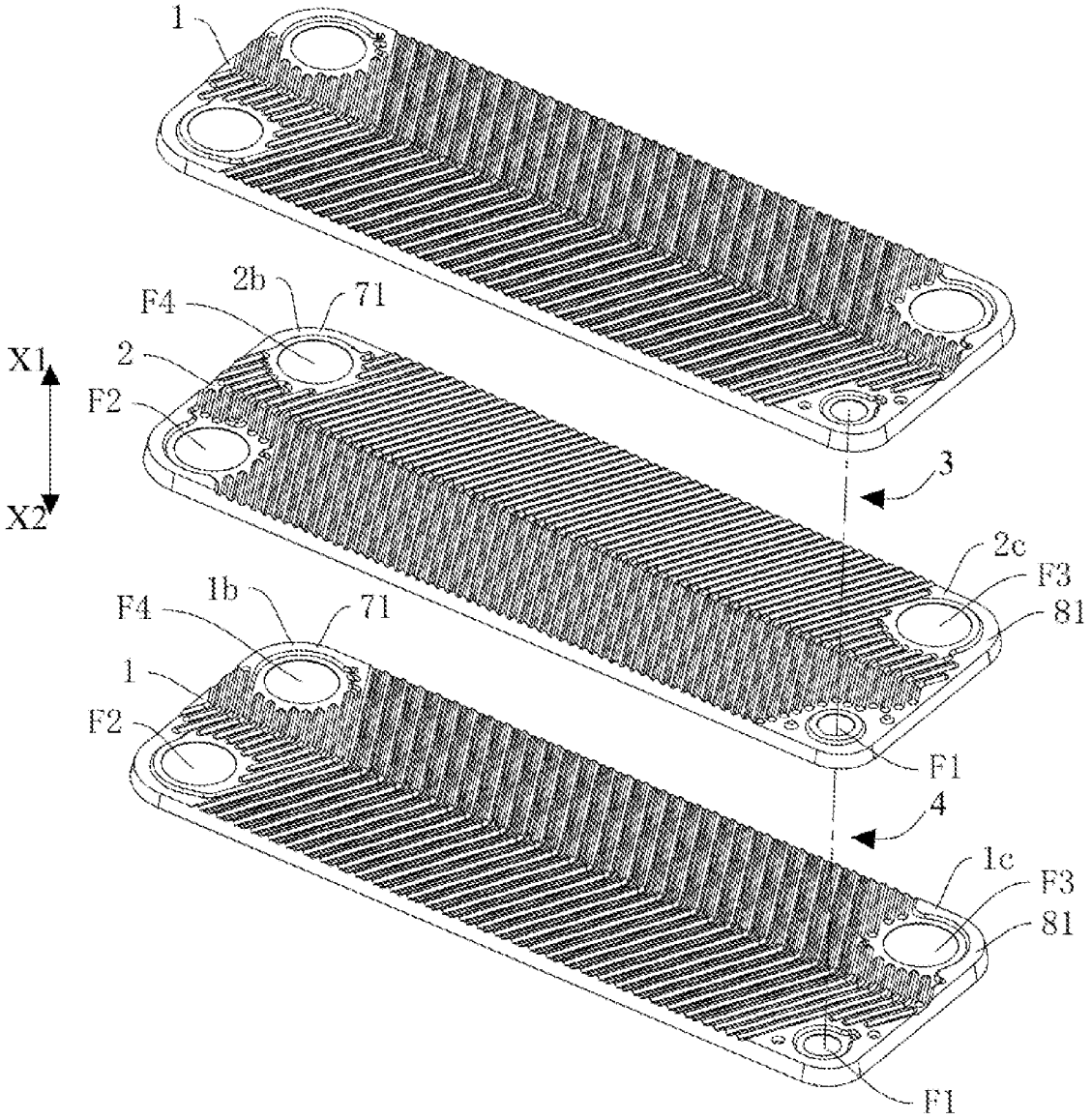
FIG. 14 is another partially exploded view of the plate heat exchanger in accordance with the embodiment of the present disclosure.

In this embodiment, each heat exchange plate has the front surface and the back surface. As shown in FIG. 14, the front surface of the second heat exchange plate 2 faces the X1 direction. The back surface of the second heat exchange plate 2 faces the X2 direction. The description "the first inter-plate channel 3 is located between a front surface of one second heat exchange plate 2 and one first heat exchange plate 1 located adjacent to the second heat exchange plate 2 along one side" means that the first inter-plate channel 3 is located between the front surface of the second heat exchange plate 2 and the back surface of the adjacent first heat exchange plate 1. Similarly, the description "the second inter-plate channel 4 is located between a back surface of the second heat exchange plate 2 and another first heat exchange plate 1 located adjacent to the second heat exchange plate 2 along another side" means that the second inter-plate channel 4 is located between the back surface of the second heat exchange plate 2 and the front surface of the adjacent first heat exchange plate 1.

In plate heat exchangers in the prior art, since temperature on a refrigerant inlet side is low, and the heat exchange medium that exchanges heat with the refrigerant flows to a position corresponding to the refrigerant inlet, there is a greater risk of freezing. Once freezing occurs, it will easily lead to volume expansion, causing the heat exchange plates in the frozen parts to crack or be damaged due to stress, causing the refrigerant to bypass to the heat exchange medium side, and causing the plate heat exchanger to fail. In order to reduce or prevent the freezing phenomenon of the heat exchange medium there, in this embodiment, the front surface of the first heat exchange plate 1 and the back surface of the second heat exchange plate 2 are connected at the first corner hole F1 through the first flat joint portion 1*a* and the second flat joint portion 2*a*. Moreover, the first corner hole F1 is located in the first flat joint portion 1*a* and the second flat joint portion 2*a*. As a result, the second inter-plate channel 4 is closed by the first flat joint portion 1*a* and the second flat joint portion 2*a* at a corresponding position of the first corner hole F1, so that a distance is formed between an edge of the second inter-plate channel 4 and the first corner hole F1, thereby ensuring that the fluid in the second inter-plate channel 4 will not flow to the corresponding position of the first corner hole F1. When the plate heat exchanger is used as an evaporator, the heat exchange medium in the second inter-plate channel 4 will not flow to the corresponding position of the first corner hole F1, and there will be no problem that the heat exchange medium is retained at the corresponding position of the first corner hole F1. This prevents the heat exchange medium from freezing due to the low temperature of the refrigerant in the first inter-plate channel 3 at the first corner hole F1, which can effectively extend the life of the plate heat exchanger when used as the evaporator and improve its durability.

In some embodiments, the front surface of the first flat joint portion 1*a* and the back surface of the second flat joint portion 2*a* are connected by a plane. The connection method is not specifically limited, for example, the first flat joint portion 1*a* and the second flat joint portion 2*a* may be soldered through copper foil, or may be bonded, etc.

Figure 2:
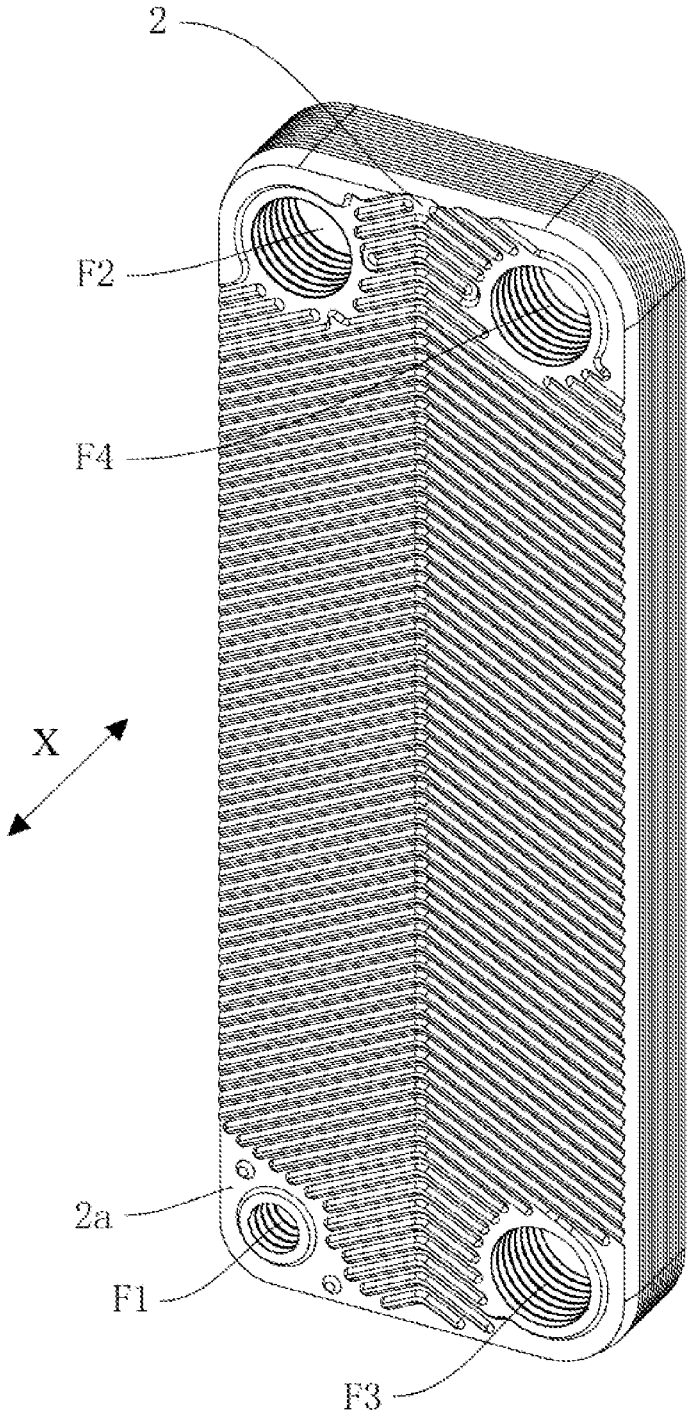
FIG. 2 is a partial structural view of the plate heat exchanger in accordance with the embodiment of the present disclosure.
Figure 3:
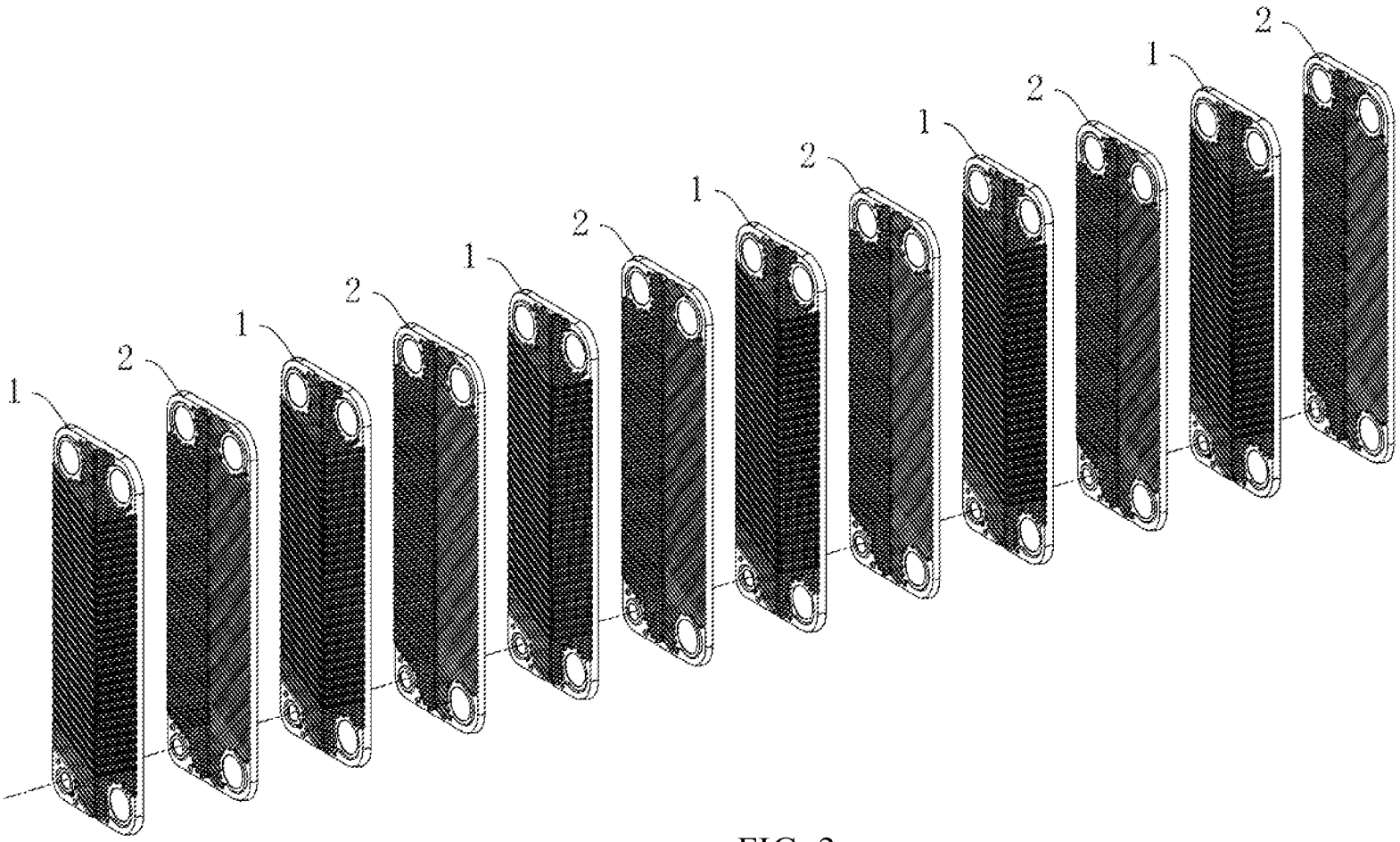
FIG. 3 is an exploded view of the plate heat exchanger in accordance with the embodiment of the present disclosure.
Figure 4:
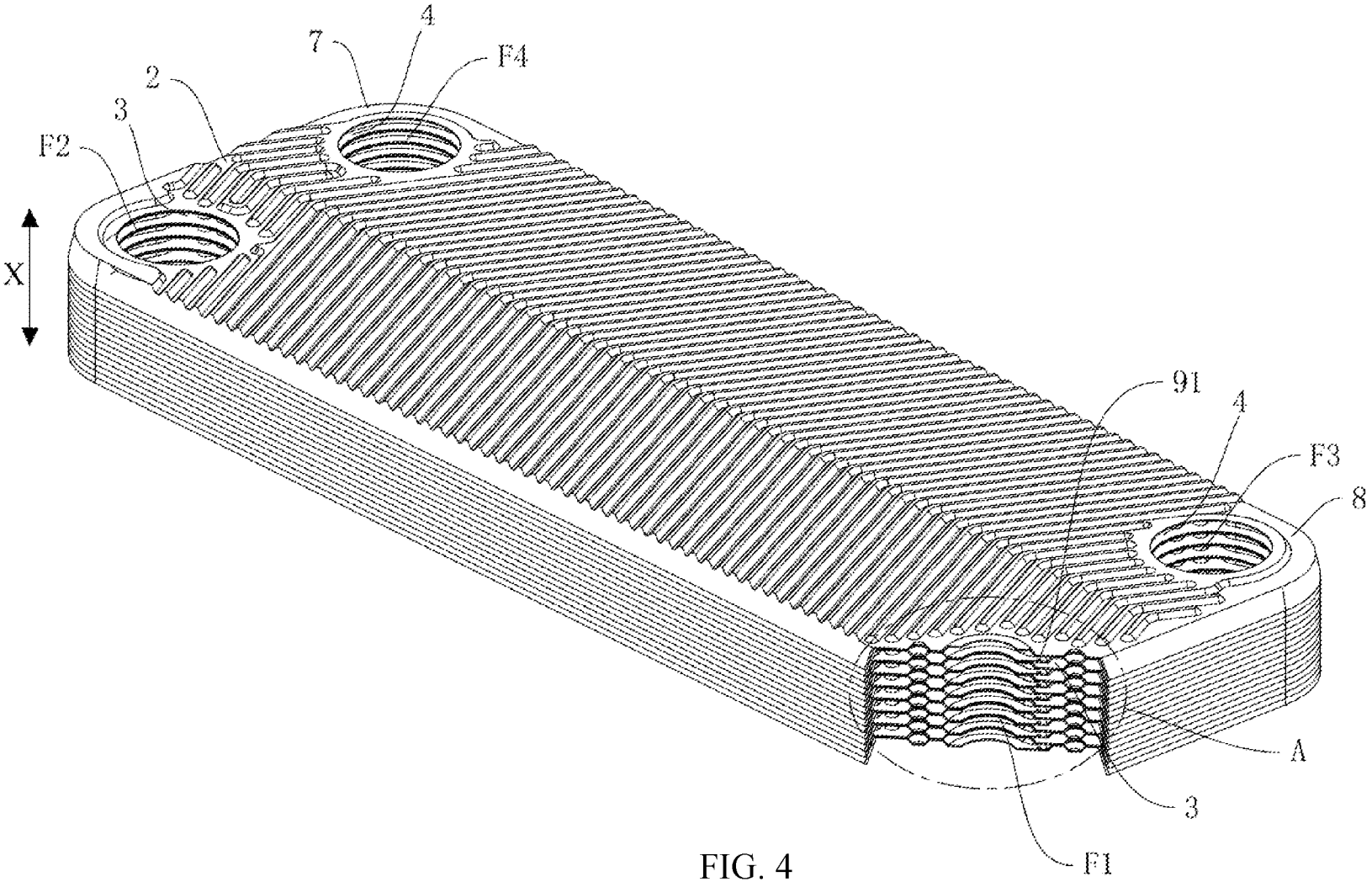
FIG. 4 is a partial cross-sectional view of the plate heat exchanger in accordance with the embodiment of the present disclosure.
Figure 5:
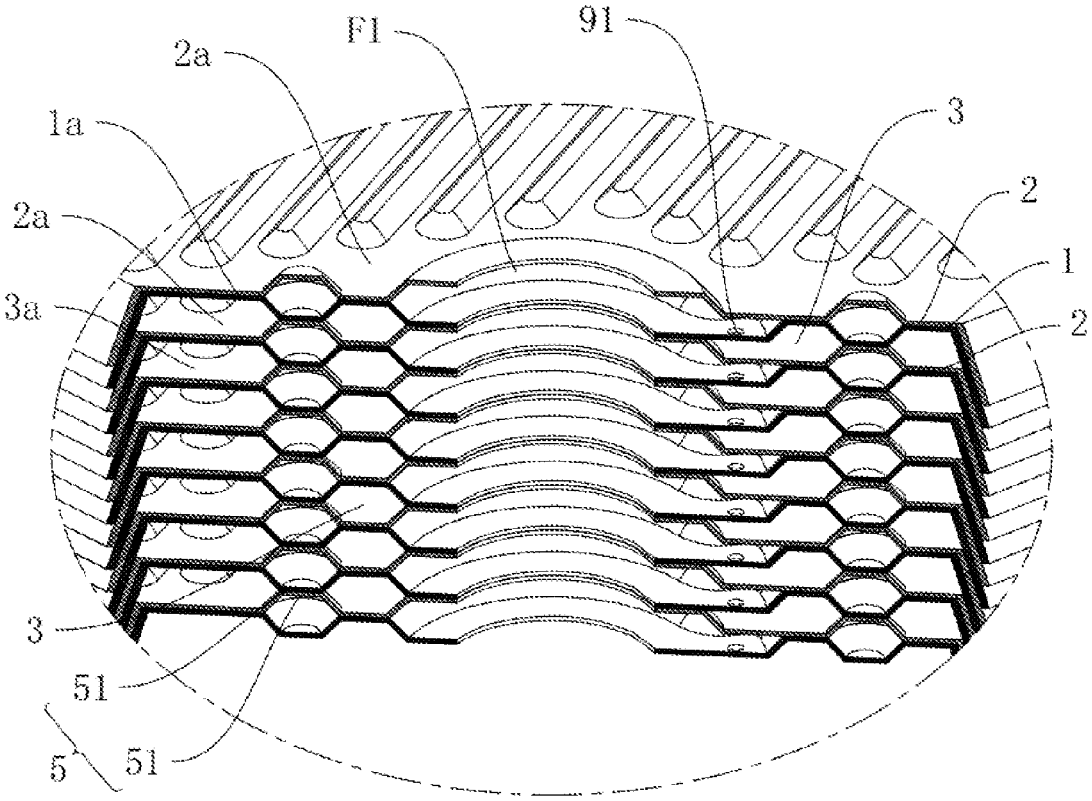
FIG. 5 is an enlarged structural view of part of circle A in FIG. 4.
Figure 6:
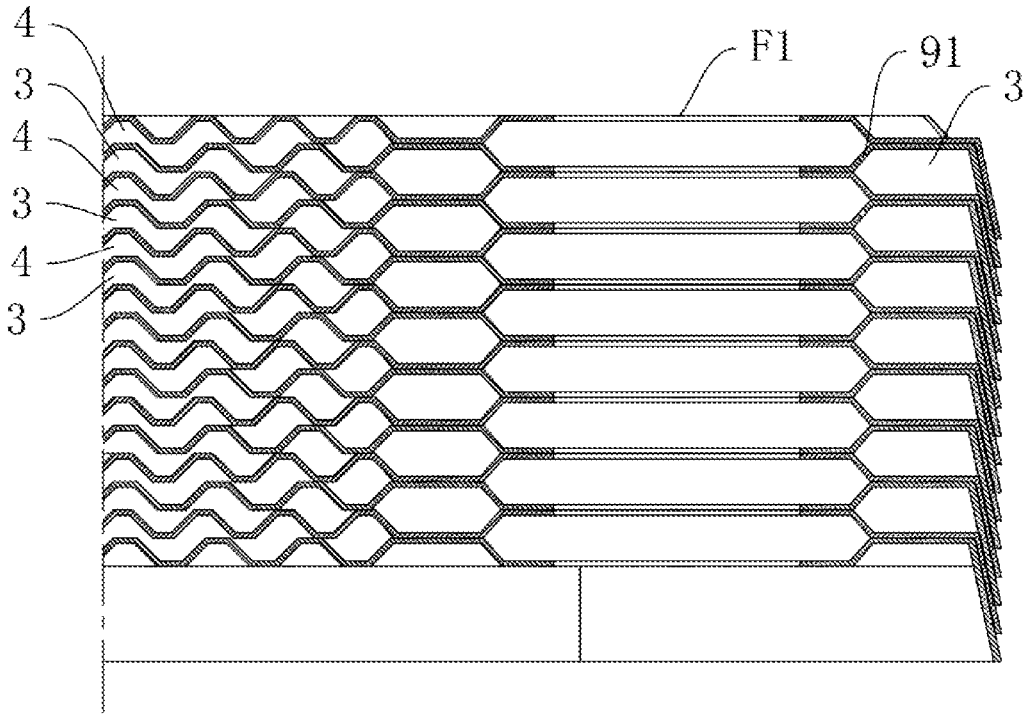
FIG. 6 is a partial cross-sectional view of a first corner hole of the plate heat exchanger in accordance with the embodiment of the present disclosure.
Figure 7:
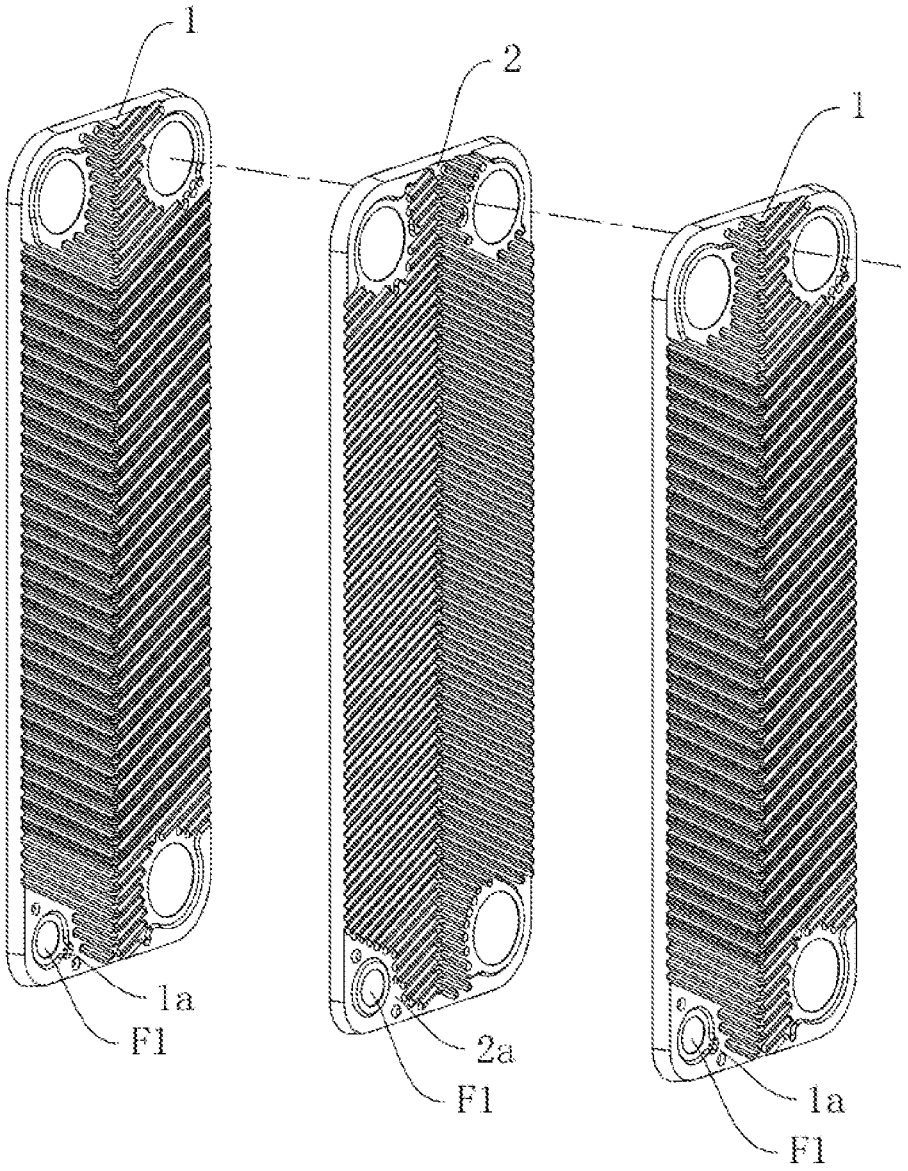
FIG. 7 is a partially exploded view of the plate heat exchanger in accordance with the embodiment of the present disclosure.
Figure 10:
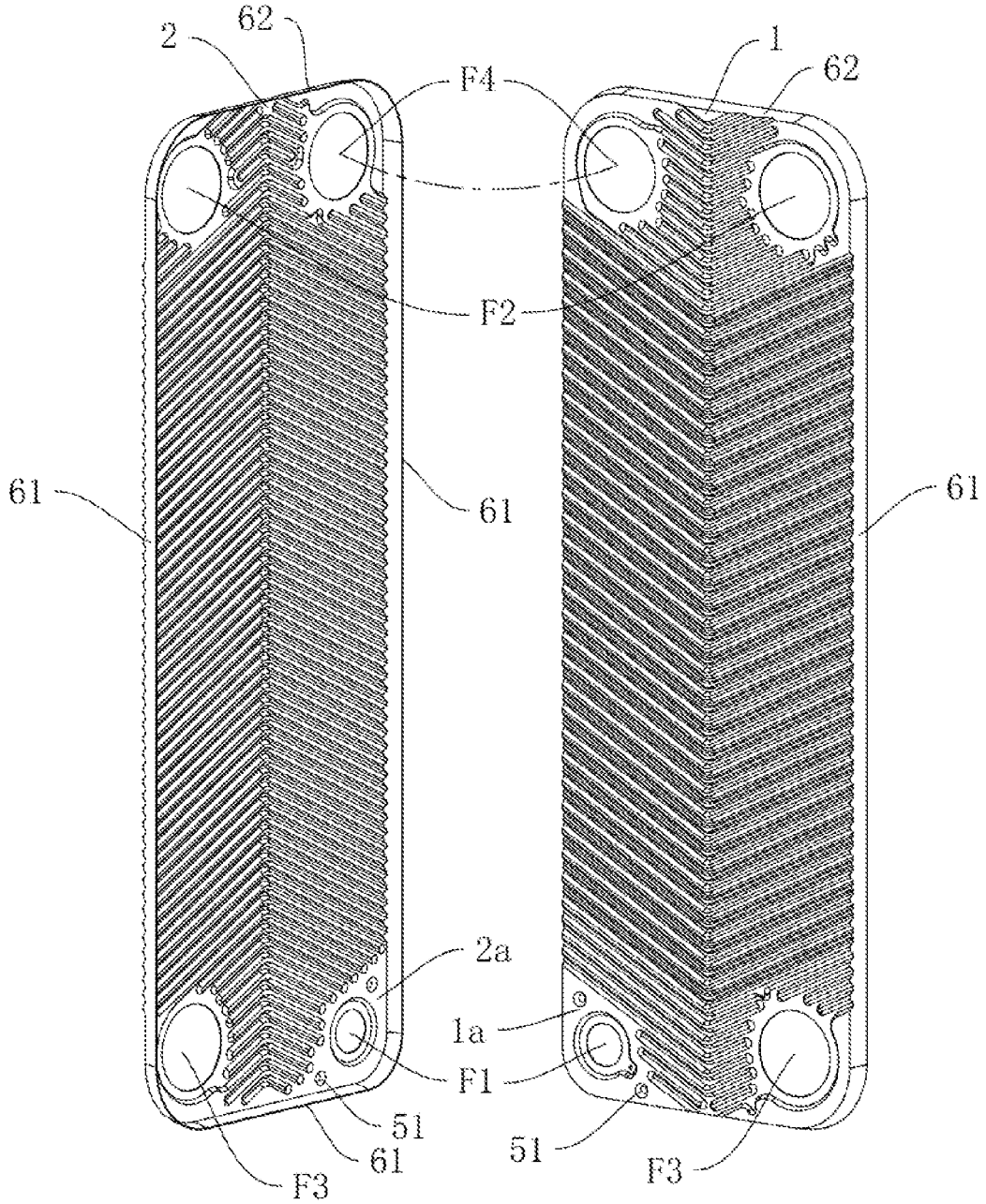
FIG. 10 is an exploded view of a back surface of the second heat exchange plate and the adjacent first heat exchange plate in accordance with the embodiment of the present disclosure.
Figure 11:
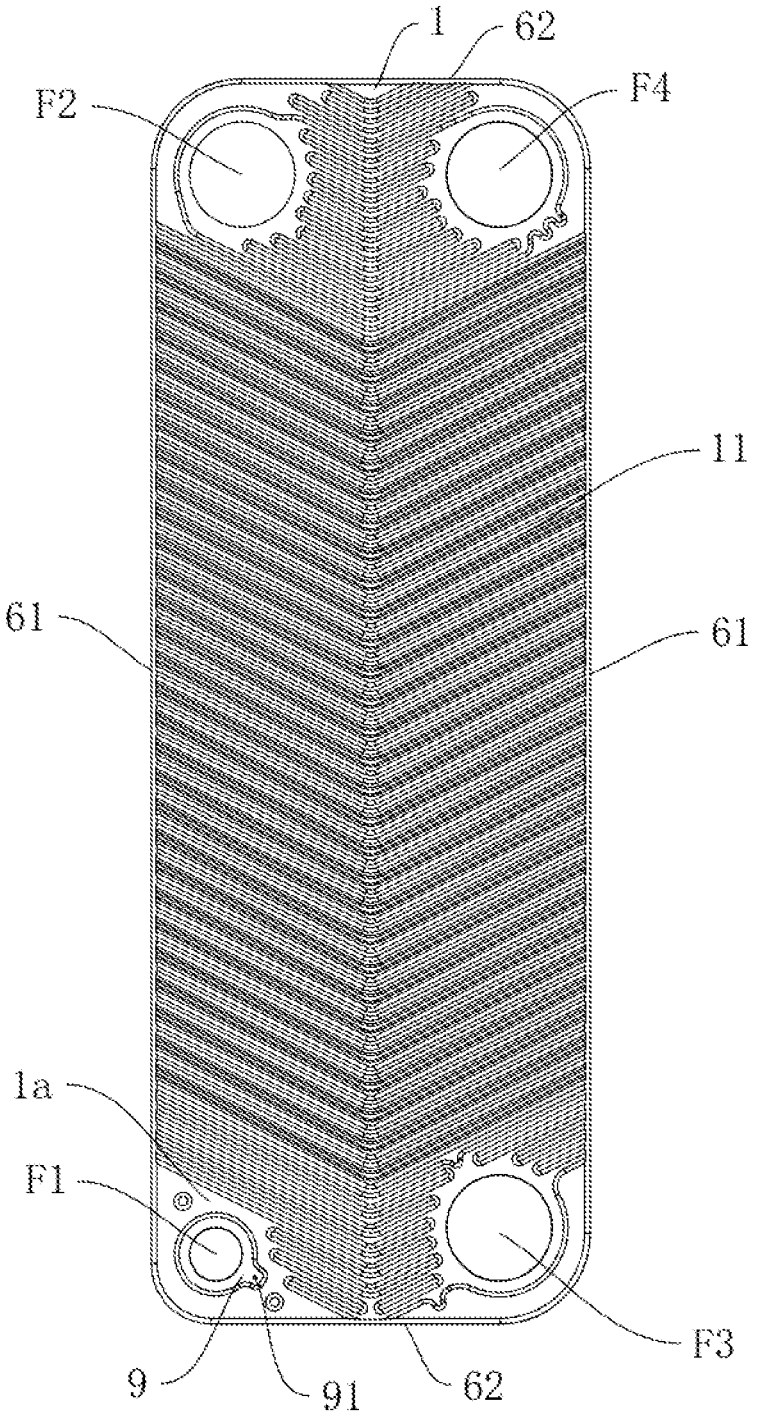
FIG. 11 is a front view of the first heat exchange plate in accordance with the embodiment of the present disclosure.
Figure 12:
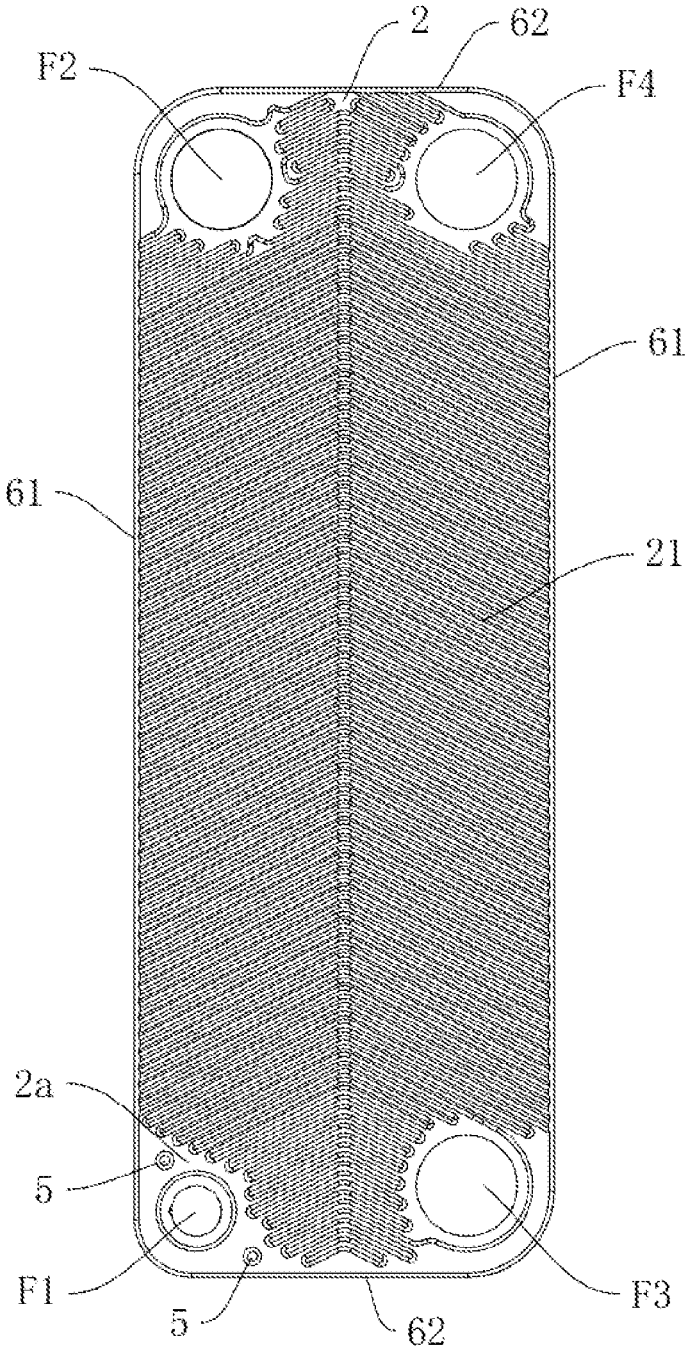
FIG. 12 is a front view of the second heat exchange plate in accordance with the embodiment of the present disclosure.

Referring to FIG. 2, FIG. 5 and FIG. 10, the back side of the second heat exchange plate 2 is connected to the adjacent first heat exchange plate 1 through the first flat joint portion 1*a* and the second flat joint portion 2*a*. This results in a large planar structure appearing between the front surface of the second heat exchange plate 2 and the back surface of the adjacent first heat exchange plate 1. That is, a large area of space appears between the front surface of the second flat joint portion 2*a* and the back surface of the adjacent first flat joint portion 1*a*. When the first inter-plate channel 3 is used to circulate the refrigerant, the first corner hole F1 needs to withstand a large pressure as an inlet of the refrigerant, which can easily cause plane deformation there and cause the connection portion to be torn. In serious cases, the plate may be torn due to force and the refrigerant may bypass to the heat exchange medium side, causing the plate heat exchanger to fail. Therefore, in order to improve the strength at the refrigerant inlet, the plate heat exchanger in this embodiment further includes at least one connection portion 5. The connection portion 5 connects the front surface of the second flat joint portion 2*a* and the adjacent first flat joint portion 1*a*, so that the first inter-plate channel 3 is connected through the connection portion 5 between the first flat joint portion 1*a* and the second flat joint portion 2*a* on two sides at the position of the first corner hole F1. That is, by providing the connection portion 5, the connection strength between the front surface of the second flat joint portion and the adjacent first flat joint portion, which is spaced apart from the front surface of the second flat joint portion, is improved, thereby significantly improving the strength between the plates in the refrigerant inlet area, and improves the pressure resistance, reliability and durability of the plate heat exchanger.

Figure 8:
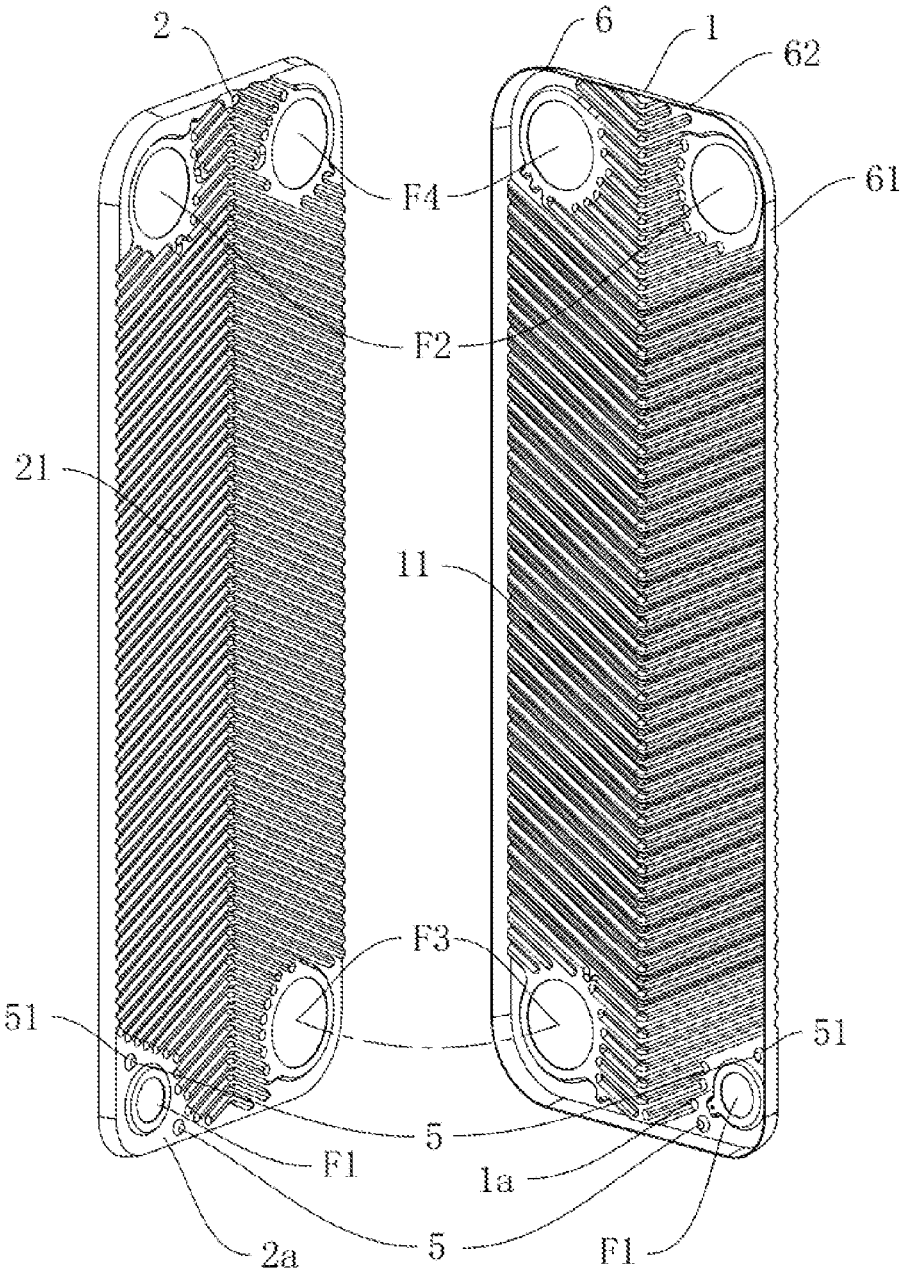
FIG. 8 is an exploded view of a front surface of a second heat exchange plate and an adjacent first heat exchange plate in accordance with the embodiment of the present disclosure.

Referring to FIG. 8, in some embodiments, the connection portion 5 includes a boss 51 which is provided on at least one of the first flat joint portion 1*a* and the second flat joint portion 2*a*. The boss 51 protrudes toward the first inter-plate channel 3. In this embodiment, the first flat joint portion 1*a* may have the boss 51, or both the first flat joint portion 1*a* and the second flat joint portion 2*a* may have the bosses 51. When both the first flat joint portion 1*a* and the second flat joint portion 2*a* have the bosses 51, the boss 51 on the first flat joint portion 1*a* and the boss 51 on the second flat joint portion 2*a* correspond along the thickness direction of the plate heat exchanger, which ensures that the bosses 51 of the two plates can be connected correspondingly when the plates are stacked. This embodiment will be described by taking an example in which both the first flat joint portion 1*a* and the second flat joint portion 2*a* have bosses 51. The boss 51 on the first flat joint portion 1*a* is a part of the first heat exchange plate 1. The boss 51 on the first flat joint portion 1*a* and the first heat exchange plate 1 are of an integrated structure and can be pressed during the production process of the first heat exchange plate 1. Similarly, the boss 51 on the second flat joint portion 2*a* is a part of the second heat exchange plate 2. The boss 51 on the second flat joint portion 2*a* and the second heat exchange plate 2 have an integrated structure and can be pressed during the production process of the second heat exchange plate 2. The boss 51 is integrally formed with the heat exchange plate, which can further improve the structural strength of the heat exchange plate.

Figure 9:
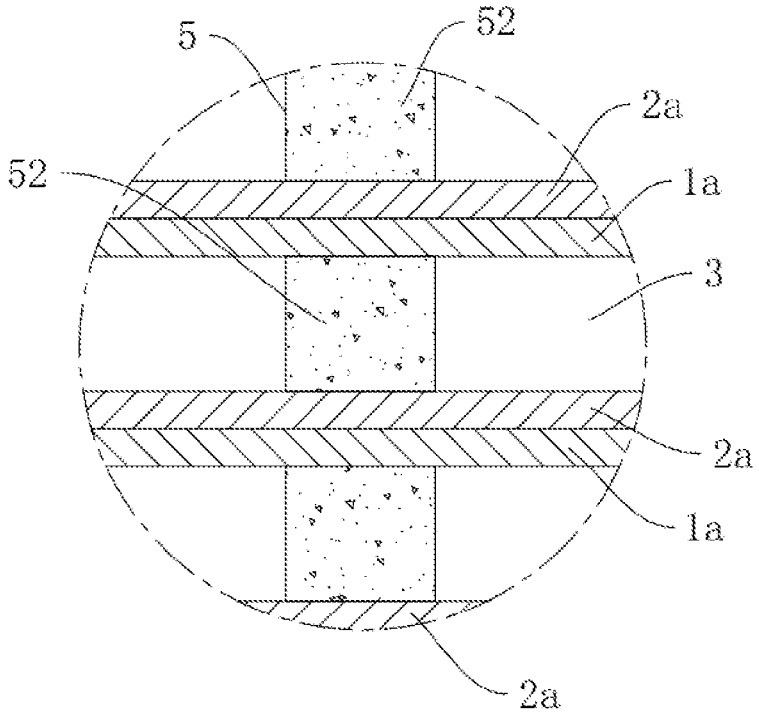
FIG. 9 is a structural view of a connection portion using a connection block in accordance with the embodiment of the present disclosure.

Referring to FIG. 9, in other embodiments, the connection portion 5 includes a plurality of connecting blocks 52 which are located in the first inter-plate channels 3. The connecting block 52 is connected to the first flat joint portion 1*a* and the second flat joint portion 2*a* on two sides of the first inter-plate channel 3. In this embodiment, the connection blocks 52 are placed in corresponding positions during the stacking process of the heat exchange plates, and are then connected to the heat exchange plates by brazing or bonding. In this embodiment, the connecting block 52 has a second contact surface 52*a*. A width of the second contact surface 52*a* is greater than or equal to 0.5 mm to ensure a firm connection.

In the above embodiment, the shape of the contact surface of the connection portion 5 is not specifically limited, and may be dot-shaped, annular, strip-corrugated, etc.

Referring to FIG. 8, and FIG. 10 to FIG. 12, the plate heat exchanger has a flange 6. In this embodiment, the flange 6 is an outer flange of the heat exchange plate. In this embodiment, the flange 6 is folded from the front surface to the back surface of the heat exchange plate. Referring to FIG. 5, a circulation gap 3*a* is formed between the connection portion 5 and the flange 6, which is conducive to the flow of refrigerant through the circulation gap 3*a*, conducive to enhancing the refrigerant distribution effect and improving distribution uniformity. At the same time, the problem of refrigerant retention due to the connection between the connection portion 5 and the flange 6, which in turn causes the heat exchange medium at the corresponding position of the second inter-plate channel 4 to freeze, is avoided.

In this embodiment, the flange 6 includes at least one first side 61 and at least one second side 62. Specifically, the number of both the first side 61 and the second side 62 is two. The two first sides 61 are disposed opposite to each other. The two second sides 62 are disposed opposite to each other. The first sides 61 and the second sides 62 are connected. Moreover, junctions between the first side 61 and the second side 62 are rounded. On the peripheral side of the first corner hole F1, the edge of the second inter-plate channel 4 connects the first side 61 and the second side 62. The first corner hole F1 is located between the edge of the second inter-plate channel 4 and an outer edge of the corner adjacent to the first corner hole F1. A length of the first side 61 is greater than a length of the second side 62.

Figure 13:
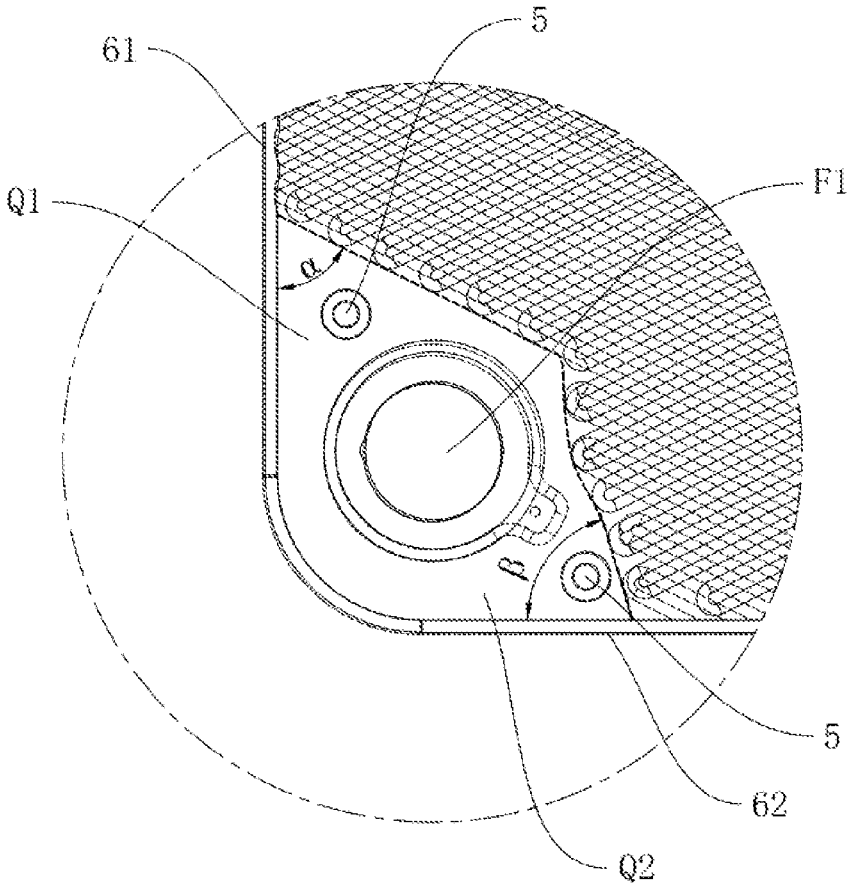
FIG. 13 is a structural view of the first heat exchange plate and the second heat exchange plate at a first corner hole site in accordance with the embodiment of the present disclosure.

Referring to FIG. 13, furthermore, in order to smoothly flow and guide the heat exchange medium in the second inter-plate channel 4 from the peripheral side of the first corner hole F1, and avoid the heat exchange medium from being frozen adjacent to the first corner hole F1 due to the low temperature of the refrigerant, along the edge of the second inter-plate channel 4 from the first side 61 to the second side 62, vertical distances from the points on the edge of the second inter-plate channel 4 to the second side 62 decrease, for example decrease gradually, which avoids the problem of detention zone. Furthermore, the edge of the second inter-plate channel 4 and the first side 61 form a first included angle $\alpha$. An opening angle of the first included angle $\alpha$ faces the first corner hole F1, wherein $10° \leq$the first included angle $\alpha \leq 30°$. The use of a large slope diversion design improves the diversion effect of the heat exchange medium at the edge of the second inter-plate channel 4, reduces the flow time of the heat exchange medium there and reduces the risk of freezing. Besides, the edge of the second inter-plate channel 4 and the second side 62 form a second included angle $\beta$. An opening angle of the second included angle $\beta$ faces the first angle hole F1, wherein $70° \leq$the second included angle $\beta \leq 90°$. Similarly, the large-slope diversion design reduces the risk of freezing and does not occupy the second inter-plate channel 4 too much. As a result, the heat exchange area between the second inter-plate channel 4 and the first inter-plate channel 3 is ensured, thereby ensuring the heat exchange performance and heat exchange effect. In this embodiment, a minimum distance from the edge of the second inter-plate channel 4 to the edge of the first corner hole F1 is greater than or equal to 2 mm, such as 2.5 mm, 3 mm, 3.5 mm, 4 mm, 5 mm, etc. This ensures that there is a distance between the heat exchange medium in the second inter-plate channel 4 and the first corner hole F1, which reduces the risk of freezing, while ensuring the connection strength there and improving durability.

Referring to FIG. 4 again, $10° \leq$the first included angle $\alpha \leq 30°$, $70° \leq$the second included angle $\beta \leq 90°$, which causes the heat exchange plate to have a large-area planar portion in at least part of the peripheral area of the first corner hole F1, thereby causing the first inter-plate channel 3 to have an empty area at the corresponding position. In order to enhance the strength of the plate heat exchanger in this area, the connection portion 5 is provided. Further, an area among the edge of the second inter-plate channel 4, the first edge 61 and the edge of the first corner hole F1 is defined as a first area Q1, wherein at least one connection portion 5 is located in the first area Q1; and/or, an area among the edge of the second inter-plate channel 4, the second side 62 and the edge of the first corner hole F1 is defined as a second area Q2, wherein at least one connection portion 5 is located in the second area Q2. In this embodiment, the connection portions 5 are provided in both the first area Q1 and the second area Q2. The number of connection portions 5 and their distribution in this area can be selected according to actual needs.

In the above embodiment, the edge of the second inter-plate channel 4 is a boundary of the first flat joint portion 1*a* and the second flat joint portion 2*a*, and located adjacent to a side of the second inter-plate channel 4, as shown in the bold dashed line in FIG. 13.

Referring to FIGS. 11 and 12 again, in the above embodiment, the first heat exchange plate 1 and the second heat exchange plate 2 are corrugated plates. The first heat exchange plate 1 has a first corrugation 11 extending to the edge of the first flat joint portion 1*a*. The second heat exchange plate 2 has a second corrugation 21 extending to the edge of the second flat joint portion 2*a*. In this embodiment, both the first corrugation 11 and the second corrugation 21 are herringbone waves. An opening angle direction of the first corrugation 11 is opposite to an opening angle direction of the second corrugation 21. In this embodiment, there is no specific limitation on the number of herringbone waves. It may be a single herringbone wave, or it may be double or more herringbone waves. The herringbone wave multiplicity of the first corrugation 11 and the herringbone wave multiplication of the second corrugation 21 may be the same or different. Besides, the opening angles of the first corrugation 11 and the second corrugation 21 may be the same or different.

Referring to FIGS. 2 and 4 again, in the above embodiment, the first heat exchange plate 1 and the second heat exchange plate 2 have third corner holes F3 corresponding to each other. The third corner holes F3 communicate with the second inter-plate channels 4. The first heat exchange plate 1 and the second heat exchange plate 2 have fourth corner holes F4 corresponding to each other. The fourth corner holes F4 communicate with the second inter-plate channels 4. Within the third corner hole F3 and the fourth corner hole F4, one of them serves as an inlet for the heat exchange medium to enter the corresponding second inter-plate channel 4; and the other of them serves as an outlet for the heat exchange medium to flow out of the corresponding second inter-plate channel 4. In this embodiment, the one farthest from the first corner hole F1 within the third corner hole F3 and the fourth corner hole F4 serves as the inlet of the heat exchange medium. In this embodiment, the fourth corner hole F4 is used as the inlet of the heat exchange medium, and the third corner hole F3 is used as the outlet of the heat exchange medium. The heat exchange medium enters the second inter-plate channel 4 through the fourth corner hole F4 and flows out of the second inter-plate channel 4 through the third corner hole F3. The refrigerant enters the first inter-plate channel 3 from the first corner hole F1 and flows out of the first inter-plate channel 3 from the second corner hole F2.

In some embodiments, the first corner hole F1 and the second corner hole F2 are distributed along one of the first sides 61; and the third corner hole F3 and the fourth corner hole F4 are distributed along the other of the first sides 61. That is, in the first inter-plate channel 3 and the second inter-plate channel 4 on adjacent sides, the fluids in the inter-plate channels on two sides form parallel flows.

In other embodiments, the first corner hole F1 and the second corner hole F2 are diagonally distributed; and the third corner hole F3 and the fourth corner hole F4 are diagonally distributed. That is, in the first inter-plate channel 3 and the second inter-plate channel 4 on adjacent sides, the fluids in the inter-plate channels on two sides form cross flows.

In the above embodiment, an orifice area of the first corner hole F1 is smaller than an orifice area of any one of the second corner hole F2, the third corner hole F3 and the fourth corner hole F4, so as to facilitate distinction. In addition, when the plate heat exchanger is used as an evaporator, the small orifice area of the first corner hole F1 can play a throttling role to increase local resistance and improve the uniform distribution of refrigerant in each first inter-plate channel 3. Since the first corner hole F1 serves as the inlet of the refrigerant and has the lowest temperature, the risk of freezing there is higher than that of other corner holes. Therefore, a contact area of the first flat joint portion 1*a* and the second flat joint portion 2*a* is larger than a contact area of any one of the flat joint portions on the peripheral side of the second corner hole F2, the third corner hole F3 and the fourth corner hole F4.

When the fourth corner hole F4 is used as the inlet of the heat exchange medium, if the second inter-plate channel 4 has a flow channel at the corner of the fourth corner hole F4, then after the heat exchange medium enters from the fourth corner hole F4, it will enter the flow channel. The heat exchange medium flows to the inter-plate channel along the first side 61 closer to the fourth corner hole F4, which may lead to uneven distribution of the heat exchange medium. Therefore, in order to improve the distribution uniformity of the heat exchange medium, this embodiment is designed as follows: referring to FIGS. 4 and 14 again, the first heat exchange plate 1 includes a third flat joint portion 1*b* which is located on the peripheral side of the first heat exchange plate 1 at the fourth corner hole F4. The second heat exchange plate 2 includes a fourth flat joint portion 2*b* which is located on the peripheral side of the second heat exchange plate 2 at the fourth corner hole F4. The plate heat exchanger includes a first blocking portion 7 which is located at the corner of the second inter-plate channel 4 on the peripheral side of the fourth corner hole F4. The second inter-plate channel 4 is blocked at the corner on the peripheral side of the fourth corner hole F4. That is, the second inter-plate channel 4 is closed at the corner on the peripheral side of the fourth corner hole F4. After the heat exchange medium enters through the fourth corner hole F4, since the corners of this part are closed, the heat exchange medium can be distributed more smoothly from the fourth corner hole F4 to an opposite side (i.e., a side of the first side 61 that is far away from the fourth corner hole F4). This is beneficial to the distribution uniformity of the heat exchange medium and improves the heat exchange effect with the refrigerant. The first blocking portion 7 includes a first protrusion 71 which is provided on at least one of the third flat joint portion 1*b* and the fourth flat joint portion 2*b*. The first protrusion 71 protrudes toward the second inter-plate channel 4. In some embodiments, one of the third flat joint portion 1*b* and the fourth flat joint portion 2*b* has the first protrusion 71. In other embodiments, both the third flat joint portion 1*b* and the fourth flat joint portion 2*b* have the first protrusions 71. The first protrusion 71 of the third flat joint portion 1*b* and the first protrusion 71 of the fourth flat joint portion 2*b* are positioned correspondingly and connected. In this embodiment, the first protrusion 71 is a part of the heat exchange plate. The first protrusion 71 and the heat exchange plate have an integrated structure, and are pressed and formed during the production process of the heat exchange plate. Of course, the first blocking portion 7 may also be an independent component from the first heat exchange plate 1 and the second heat exchange plate 2 before assembly and connection. During the stacking process of the heat exchange plates, the first blocking portion 7 is assembled to the corner of the second inter-plate channel 4 on the peripheral side of the fourth corner hole F4 for sealing. In addition, the connection through the first blocking portion 7 can also improve the connection strength of the heat exchange plates on two sides of the second inter-plate channel 4 at the fourth corner hole F4, and improve the pressure resistance at this location.

In the above embodiment, the third corner hole F3 and the first corner hole F1 are distributed along a length direction of the second side 62. A length of the second side 62 is shorter than a length of the first side 61. Therefore, the third corner hole F3 is closer to the first corner hole F1. The first corner hole F1 serves as the refrigerant inlet, and the temperature near it is relatively low. If the heat exchange medium stays in this area for a long time, there is also a risk of freezing. However, due to the small flow space at the corners of the second inter-plate channel 4 on the peripheral side of the third corner hole F3, it is easy for the flow to slow down or even stagnate, resulting in freezing. Eventually, this part of the heat exchange plate is frozen and expanded by the heat exchange medium, causing problems such as desoldering and cracking, leading to the failure of the plate heat exchanger. To this end, this embodiment is designed as follows: referring to FIGS. 4 and 14 again, the first heat exchange plate 1 includes a fifth flat joint portion 1*c* located on the peripheral side of the first heat exchange plate 1 at the third corner hole F3. The second heat exchange plate 2 includes a sixth flat joint portion 2*c* located on the peripheral side of the second heat exchange plate 2 at the third corner hole F3. The plate heat exchanger includes a second blocking portion 8 located at the corner of the second inter-plate channel 4 on the peripheral side of the third corner hole F3. That is, the second blocking portion 8 blocks the second inter-plate channel 4 at the corner on the peripheral side of the third corner hole F3. In this way, the heat exchange medium in the second inter-plate channel 4 cannot enter the corners, and the heat exchange medium will not be frozen at the corners due to the influence of retention and low-temperature environment, thereby further improving the reliability and durability of the plate heat exchanger. The second blocking portion 8 includes a second protrusion 81 which is provided on at least one of the fifth flat joint portion 1*c* and the sixth flat joint portion 2*c*. The second protrusion 81 protrudes toward the second inter-plate channel 4. In some embodiments, one of the fifth flat joint portion 1*c* and the sixth flat joint portion 2*c* has the second protrusion 81. In other embodiments, both the fifth flat joint portion 1*c* and the sixth flat joint portion 2*c* have the second protrusions 81. The second protrusion 81 of the fifth flat joint portion 1*c* and the second protrusion 81 of the sixth flat joint portion 2*c* are positioned correspondingly and connected. In this embodiment, the second protrusion 81 is a part of the heat exchange plate. The second protrusion 81 and the heat exchange plate have an integrated structure and are pressed and formed during the production process of the heat exchange plate. Of course, the second blocking portion 8 may also be an independent component from the first heat exchange plate 1 and the second heat exchange plate 2 before assembly and connection. During the stacking process of the heat exchange plates, the second blocking portion 8 is assembled to the corner of the second inter-plate channel 4 on the peripheral side of the third corner hole F3 for sealing.

Figure 15:
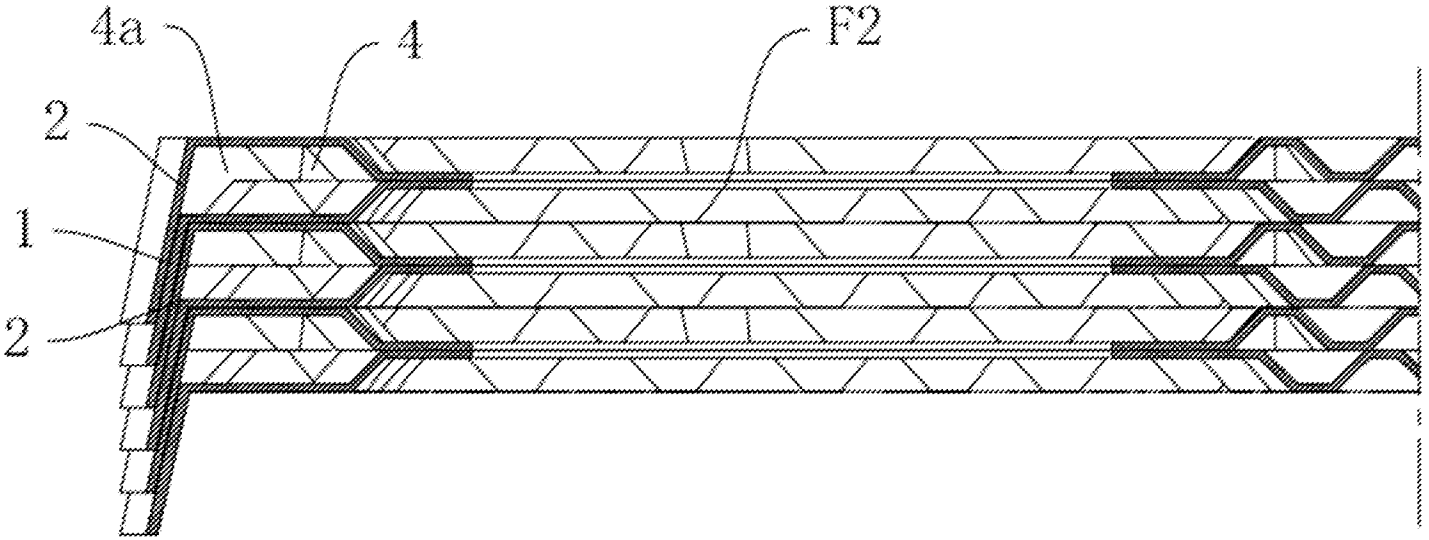
FIG. 15 is a partial cross-sectional view of a second corner hole site of the plate heat exchanger in accordance with the embodiment of the present disclosure.

Further, referring to FIG. 15, the second corner hole F2 is relatively far from the first corner hole F1. The heat exchange medium in the second inter-plate channel 4 at the position corresponding to the second corner hole F2 is less affected by the low temperature of the refrigerant at the position of the first corner hole F1, and the risk of freezing is low. In order to increase the flow area of the heat exchange medium, improve the uniformity of distribution, and enhance the heat exchange effect, the second inter-plate channel 4 has a flow guide channel 4*a*. The flow guide channel 4*a* is located at the corner of the second inter-plate channel 4 on the peripheral side of the second corner hole F2. In this way, the heat exchange medium can smoothly flow from the flow guide channel 4*a* to a side of the first side 61 that is far away from the fourth corner hole F4, thereby improving the heat exchange efficiency.

Referring to FIGS. 2 to 5 and FIGS. 7 to 14 again, the plate heat exchanger includes a distribution portion 9. The distribution portion 9 has a distribution hole 91. The distribution hole 91 communicates with the first corner hole F1 and the first inter-plate channel 3. That is, the refrigerant passes through the first corner hole F1 and then enters the first inter-plate channel 3 through the distribution hole 91, thereby enhancing the local resistance, and ensuring uniform flow of refrigerant in each first inter-plate channel 3 so as to fully utilize the heat exchange areas of the heat exchange plates.

In some embodiments, at least one of the first flat joint portion 1*a* and the second flat joint portion 2*a* includes the distribution portion 9. At this time, the distribution portion 9 serves as a part of the heat exchange plate. The distribution portion 9 and the heat exchange plate are an integral structure and are pressed during the production process of the heat exchange plate, and then the distribution portion 9 is further processed to form the distribution hole 91. One of the first flat joint portion 1*a* and the second flat joint portion 2*a* may include the distribution portion 9, for example, the first flat joint portion 1*a* includes the distribution portion 9 as shown in FIG. 10. It is also possible that both the first flat joint portion 1*a* and the second flat joint portion 2*a* include the distribution portions 9, which is not shown in the drawings.

In other embodiments, the distribution portion 9 is located between the first flat joint portion 1*a* and the second flat joint portion 2*a*. That is, the distribution portion 9 and the heat exchange plate are independent components before being assembled and connected. During the stacking assembly process, the distribution portion 9 is assembled to the corresponding position. Even if the distribution portion 9 adopts an independent design, it is also possible to choose not to assembly the distribution portion 9 during the stack assembly process. At this time, the plate heat exchanger can also be used as a condenser, which is not shown in the drawings.

In the above embodiment, the first inter-plate channels 3 and the second inter-plate channels 4 are alternately distributed along the thickness direction of the plate heat exchanger. In order to achieve better heat exchange performance and smaller pressure drop, a volume of the first inter-plate channels 3 is larger or smaller than a volume of the second inter-plate channels 4. That is, the plate heat exchanger adopts an asymmetric channel structure, forming two inter-plate channels with different volumes, which can reduce the pressure drop without affecting the heat exchange performance.

Referring to FIG. 1, in the above embodiment, the plate heat exchanger may also include an end plate 100, a connecting pipe 200, a bottom plate, and so on. The end plate 100 is installed on the front surface of the first heat exchange plate. The bottom plate is installed on the back surface of the last heat exchange plate. The connecting pipe 200 can be installed on the end plate 100. An inner cavity of the connecting pipe 200 is in fluid communication with a corresponding corner hole.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A plate heat exchanger, comprising:

a plurality of plates stacked along a thickness direction of the plate heat exchanger; the plurality of plates comprising a plurality of first heat exchange plates and a plurality of second heat exchange plates; the first heat exchange plate and the second heat exchange plate being disposed alternately along the thickness direction of the plate heat exchanger;

wherein the plate heat exchanger has a first inter-plate channel and a second inter-plate channel; the first inter-plate channel is located between a front surface of a corresponding second heat exchange plate and a corresponding first heat exchange plate disposed adjacent to the corresponding second heat exchange plate along the thickness direction of the plate heat exchanger; the second inter-plate channel is located between a back surface of the corresponding second heat exchange plate and another corresponding first heat exchange plate disposed adjacent to the corresponding second heat exchange plate along the thickness direction of the plate heat exchanger;

each first heat exchange plate and each second heat exchange plate have first corner holes corresponding with each other and communicating with the first inter-plate channel; the first heat exchange plate has a first flat joint portion in which the first corner hole of the first heat exchange plate is located; the second heat exchange plate has a second flat joint portion in which the first corner hole of the second heat exchange plate is located; a front surface of the second flat joint portion is at least partially spaced from an adjacent first flat joint portion; a back surface of the second flat joint portion is at least partially connected to another adjacent first flat joint portion;

each first heat exchange plate and each second heat exchange plate have second corner holes corresponding with each other and communicating with the first inter-plate channel;

wherein the plate heat exchanger comprises at least one connection portion which connects the front surface of the second flat joint portion and the adjacent first flat joint portion;

wherein the plate heat exchanger has a flange, and the flange comprises a first side and a second side;

wherein the first heat exchange plate and the second heat exchange plate have third corner holes corresponding with each other and communicating with the second inter-plate channel; the first heat exchange plate and the second heat exchange plate have fourth corner holes corresponding with each other and communicating with the second inter-plate channel;

wherein the first corner hole and the second corner hole are distributed diagonally; the third corner hole and the fourth corner hole are distributed diagonally;

the first heat exchange plate comprises a third flat joint portion located on a peripheral side of the fourth corner hole of the first heat exchange plate; the second heat exchange plate comprises a fourth flat joint portion located on a peripheral side of the fourth corner hole of the second heat exchange plate; the plate heat exchanger comprises a first blocking portion located at a corner of the second inter-plate channel on the peripheral side of the fourth corner hole; the first blocking portion comprises a first protrusion which is provided on at least one of the third flat joint portion and the fourth flat joint portion; the first protrusion protrudes toward the second inter-plate channel;

the first heat exchange plate comprises a fifth flat joint portion located on a peripheral side of the third corner hole of the first heat exchange plate; the second heat exchange plate comprises a sixth flat joint portion located on the peripheral side of the third corner hole of the second heat exchange plate; the plate heat exchanger comprises a second blocking portion located at a corner of the second inter-plate channel on the peripheral side of the third corner hole; the second blocking portion comprises a second protrusion which is provided on at least one of the fifth flat joint portion and the sixth flat joint portion; the second protrusion protrudes toward the second inter-plate channel; the third corner hole and the first corner hole are distributed along a length direction of the second side.

2. The plate heat exchanger according to claim 1, wherein the connection portion comprises a boss which is provided on at least one of the first flat joint portion and the second flat joint portion; the boss protrudes toward the first inter-plate channel.

3. The plate heat exchanger according to claim 1, wherein the connection portion comprises a connection block located in the first inter-plate channel; the connection block is connected to the first flat joint portion and the second flat joint portion which are located on two sides of the first inter-plate channel; the connection block has a second contact surface; a width of the second contact surface is greater than or equal to 0.5 mm.

4. The plate heat exchanger according to claim 1, wherein a circulation gap is formed between the connection portion and the flange.

5. The plate heat exchanger according to claim 4, wherein on a peripheral side of the first corner hole, an edge of the second inter-plate channel extends to the first side and the second side;

the edge of the second inter-plate channel is a boundary of the first flat joint portion and the second flat joint portion, and located adjacent to a side of the second inter-plate channel.

6. The plate heat exchanger according to claim 5, wherein a length of the first side is greater than a length of the second side; the edge of the second inter-plate channel is located in a direction from the first side to the second side, vertical distances from points on the edge of the second inter-plate channel to the second side decrease;

the edge of the second inter-plate channel and the first side form a first comprised angle; an opening angle of the first comprised angle faces the first corner hole; wherein 10°≤the first comprised angle≤30°;

the edge of the second inter-plate channel and the second side form a second comprised angle; an opening angle of the second comprised angle faces the first corner hole; wherein 70°≤the second comprised angle≤90°;

a minimum distance from the edge of the second inter-plate channel to the edge of the first corner hole is greater than or equal to 2 mm.

7. The plate heat exchanger according to claim 6, wherein the first heat exchange plate and the second heat exchange plate are corrugated plates; the first heat exchange plate has a first corrugation extending to an edge of the first flat joint portion; the second heat exchange plate has a second corrugation extending to an edge of the second flat joint portion;

an orifice area of the first corner hole is smaller than an orifice area of any one of the second corner hole, the third corner hole and the fourth corner hole;

a contact area of the first flat joint portion and the second flat joint portion is larger than a contact area of any one of a flat joint portion on a peripheral side of the second corner hole, the third corner hole and the fourth corner hole.

8. The plate heat exchanger according to claim 6, wherein the first inter-plate channel and the second inter-plate channel are provided and alternately distributed along the thickness direction of the plate heat exchanger; the first inter-plate channels are configured to circulate a refrigerant; the first corner holes are configured to allow the refrigerant to flow into the first inter-plate channels; the second inter-plate channels are not in fluid communication with the first inter-plate channels; a volume of each first inter-plate channel is greater than or smaller than a volume of each second inter-plate channel.

9. The plate heat exchanger according to claim 7, wherein the second inter-plate channel comprises a flow guide channel which is located at the corner of the second inter-plate channel on the peripheral side of the second corner hole;

the plate heat exchanger comprises a distribution portion; the distribution portion defines a distribution hole communicating with the first corner hole and the first inter-plate channel;

the distribution portion is provided on at least one of the first flat joint portion and the second flat joint portion; or the distribution portion is located between the first flat joint portion and the second flat joint portion.

10. A plate heat exchanger, comprising:

a plurality of plates stacked along a thickness direction of the plate heat exchanger; the plurality of plates comprising a plurality of first heat exchange plates and a plurality of second heat exchange plates; the first heat exchange plate and the second heat exchange plate being disposed alternately along the thickness direction of the plate heat exchanger;

wherein the plate heat exchanger has a first inter-plate channel configured to circulate a refrigerant and a second inter-plate channel configured to circulate a heat exchange medium; the first inter-plate channel is not in fluid communication with the second inter-plate channel; the first inter-plate channel is located between a front surface of a corresponding second heat exchange plate and a corresponding first heat exchange plate disposed adjacent to the corresponding second heat exchange plate along the thickness direction of the plate heat exchanger; the second inter-plate channel is located between a back surface of the corresponding second heat exchange plate and another corresponding first heat exchange plate disposed adjacent to the corresponding second heat exchange plate along the thickness direction of the plate heat exchanger;

each first heat exchange plate and each second heat exchange plate have first corner holes corresponding with each other and communicating with the first inter-plate channel; the first heat exchange plate has a first flat joint portion in which the first corner hole of the first heat exchange plate is located; the second heat exchange plate has a second flat joint portion in which the first corner hole of the second heat exchange plate is located; a front surface of the second flat joint portion is at least partially spaced from an adjacent first flat joint portion; a back surface of the second flat joint portion is at least partially connected to another adjacent first flat joint portion;

each first heat exchange plate and each second heat exchange plate have second corner holes corresponding with each other and communicating with the first inter-plate channel;

the plate heat exchanger comprises a plurality of connection blocks which are independent components before being assembled and connected to the plurality of first heat exchange plates and the plurality of second heat exchange plates; each connection block connects the front surface of the second flat joint portion and the adjacent first flat joint portion;

wherein the plate heat exchanger has a flange, and the flange comprises a first side and a second side;

wherein the first heat exchange plate and the second heat exchange plate have third corner holes corresponding with each other and communicating with the second inter-plate channel; the first heat exchange plate and the second heat exchange plate have fourth corner holes corresponding with each other and communicating with the second inter-plate channel;

wherein the first corner hole and the second corner hole are distributed diagonally; the third corner hole and the fourth corner hole are distributed diagonally;

the first heat exchange plate comprises a third flat joint portion located on a peripheral side of the fourth corner hole of the first heat exchange plate; the second heat exchange plate comprises a fourth flat joint portion located on a peripheral side of the fourth corner hole of the second heat exchange plate; the plate heat exchanger comprises a first blocking portion located at a corner of the second inter-plate channel on the peripheral side of the fourth corner hole; the first blocking portion comprises a first protrusion which is provided on at least one of the third flat joint portion and the fourth flat joint portion; the first protrusion protrudes toward the second inter-plate channel;

the first heat exchange plate comprises a fifth flat joint portion located on a peripheral side of the third corner hole of the first heat exchange plate; the second heat exchange plate comprises a sixth flat joint portion located on the peripheral side of the third corner hole of the second heat exchange plate; the plate heat exchanger comprises a second blocking portion located at a corner of the second inter-plate channel on the peripheral side of the third corner hole; the second blocking portion comprises a second protrusion which is provided on at least one of the fifth flat joint portion and the sixth flat joint portion; the second protrusion protrudes toward the second inter-plate channel; the third corner hole and the first corner hole are distributed along a length direction of the second side.

11. The plate heat exchanger according to claim 10, wherein each connection block is located in the first inter-plate channel; the connection block is connected to the first flat joint portion and the second flat joint portion which are located on two sides of the first inter-plate channel; the connection block has a second contact surface; a width of the second contact surface is greater than or equal to 0.5 mm.

12. The plate heat exchanger according to claim 10, wherein a circulation gap is formed between the connection portion and the flange.

13. The plate heat exchanger according to claim 12, wherein on a peripheral side of the first corner hole, an edge of the second inter-plate channel connects the first side and the second side;

the edge of the second inter-plate channel is a boundary of the first flat joint portion and the second flat joint portion, and located adjacent to a side of the second inter-plate channel.

14. The plate heat exchanger according to claim 13, wherein a length of the first side is greater than a length of the second side; the edge of the second inter-plate channel is located in a direction from the first side to the second side; vertical distances from points on the edge of the second inter-plate channel to the second side decrease;

the edge of the second inter-plate channel and the first side form a first comprised angle; an opening angle of the first comprised angle faces the first corner hole; wherein $10° \leq$the first comprised angle$\leq 30°$;

the edge of the second inter-plate channel and the second side form a second comprised angle; an opening angle of the second comprised angle faces the first corner hole; wherein $70° \leq$the second comprised angle$\leq 90°$;

a minimum distance from the edge of the second inter-plate channel to the edge of the first corner hole is greater than or equal to 2 mm.

15. The plate heat exchanger according to claim 14, wherein the first heat exchange plate and the second heat exchange plate are corrugated plates; the first heat exchange plate has a first corrugation extending to an edge of the first flat joint portion; the second heat exchange plate has a second corrugation extending to an edge of the second flat joint portion;

an orifice area of the first corner hole is smaller than an orifice area of any one of the second corner hole, the third corner hole and the fourth corner hole;

a contact area of the first flat joint portion and the second flat joint portion is larger than a contact area of any one of a flat joint portion on a peripheral side of the second corner hole, the third corner hole and the fourth corner hole.

16. The plate heat exchanger according to claim 14, wherein a first inter-plate channel and a second inter-plate channel are provided and alternately distributed along the thickness direction of the plate heat exchanger; the first corner holes are configured to allow the refrigerant to flow into the first inter-plate channels; a volume of each first inter-plate channel is greater than or smaller than a volume of each second inter-plate channel.

17. The plate heat exchanger according to claim 15, wherein the second inter-plate channel comprises a flow guide channel which is located at the corner of the second inter-plate channel on the peripheral side of the second corner hole;

the plate heat exchanger comprises a distribution portion; the distribution portion defines a distribution hole communicating with the first corner hole and the first inter-plate channel;

the distribution portion is provided on at least one of the first flat joint portion and the second flat joint portion; or the distribution portion is located between the first flat joint portion and the second flat joint portion.

* * * * *